US005919099A

United States Patent [19]

Woods

[11] Patent Number: 5,919,099

[45] Date of Patent: Jul. 6, 1999

[54] GOLF SWING TRAINING DEVICE

[76] Inventor: John Woods, 36 Althouse Ave., East Rockaway, N.Y. 11518

[21] Appl. No.: 09/057,201

[22] Filed: Apr. 8, 1998

[51] Int. Cl.[6] ..... A63B 69/36

[52] U.S. Cl. ..... 473/257; 473/268; 473/273; 473/222; 473/409

[58] Field of Search ..... 473/257, 220, 473/222, 268, 267, 273, 409, 219, 225

[56] References Cited

U.S. PATENT DOCUMENTS

| | | | |
|---|---|---|---|
| 3,373,612 | 3/1968 | Thompson et al. | 473/225 X |
| 3,601,408 | 8/1971 | Wright | 473/225 |
| 4,304,406 | 12/1981 | Cromarty | 473/225 |
| 4,434,983 | 3/1984 | Taggart | 473/273 |
| 5,332,211 | 7/1994 | Rife et al. | 473/257 X |

*Primary Examiner*—George J. Marlo

*Attorney, Agent, or Firm*—Galgano & Burke

[57] ABSTRACT

A training aid for developing a golfer's swing which comprises a swing assembly having reference markings disposed thereon which define a desired swing path for a golf club relative to the reference markings. The training aid further comprises a light source which continually casts at least a portion of a golfer's shadow and a shadow of the golf club onto the swing assembly in general relation to the markings allowing the golfer to readily visualize and compare his/her swing path with an "ideal" swing path during a golfer's swing. The invention also includes a method of training a golfer's swing, comprising the steps of: 1) providing a swing assembly having reference markings disposed thereon which define a desired swing path for the golf club relative to the markings; 2) positioning a golfer with the golf club proximate the swing assembly; and 3) projecting a light from a light source at the golfer and the golf club both prior to and during a golfer's swing such that at least a portion of the golfer's shadow and the shadow of the golf club are cast onto the swing assembly in general relation to the markings.

21 Claims, 11 Drawing Sheets

GOLF SWING TRAINING DEVICE

BACKGROUND OF THE INVENTION

1. Field of the Invention

The invention relates to a swing training aid and a method for developing a more consistent swing along a specified swing plane, especially intended for golf. More particularly, the invention relates to a visual training aid for developing a swing which incorporates a light which is projected onto a player and a hitting instrument in such a fashion that the player's shadow and the shadow of the instrument are cast onto a surface having a plurality of markings disposed thereon which depict an ideal swing plane for the instrument and reference points for positioning the player prior to and during the swing.

2. State of the Art

Training aids for various sports such as golf, baseball and racket sports are well known in the art. By far, the majority of these training aids focus on one particular aspect of the above sports, namely, the swing. It is also well known that there exists an abundance of literature focused on this subject which describe various position sequences, turning movements and key elements for correcting and/or perfecting the swing. However, as can be appreciated, converting written or verbal instructions into correct body movements can often be a difficult, time consuming and not necessarily accurate process. Moreover, even with the best written or verbal instruction, visualization of the correct and/or perfect swing can be quite toilsome.

For example, golfers work to develop an "ideal" golf swing which can generally be defined (within the contexts of golf) to mandate three principles: 1) to contact the ball with the club face controlled to produce the desired ball trajectory (e.g., square for straight line or an open or closed face to produce a "fade" or "draw"); 2) to contact the ball such that the club head velocity component resides in a single direction which is transferred through the center of gravity of the golf ball directed along the target line; and 3) to consistently swing golf clubs of varying lengths in accordance with principles (1) and (2) above. Moreover, a golf swing is a motion that attempts to accelerate the club head to a maximum velocity at impact with the ball keeping in mind the above principles. However, several other important factors further complicate the golf swing as well: 1) the "ideal" swing plane is at an angle to the ground surface; 2) the velocity at the top of the golf swing is zero; and 3) the golfer constantly manipulates the golf club during the course of the swing to position the club head normal to the golf ball at impact.

As can be appreciated, even the slightest deviation from the ideal swing can cause a golf ball to fly off line and, in some cases, a more deviant swing can lead to disastrous results, e.g., hook, slice or even missing the golf ball entirely. Only under certain circumstances would a golfer stray from the above principles, e.g., to intentionally "fade" or "draw" the golf ball (see FIG. 5D and FIG. 5E, respectively).

Other sports, such as baseball and various racket sports, have similar principles for defining their respective "ideal" swings for hitting baseballs and/or tennis balls, respectively. For example, in tennis, the ideal swing for a forehand swing comprises both movement in the forward direction as well as movement in an upward direction relative to the tennis ball. Hitting the ball in this manner provides "top-spin" on the ball which, in most cases, is the preferred spinning movement of the tennis ball.

As mentioned above, many swing training aids have been developed in the past to assist athletes in developing their swings. This is particularly true with golf where numerous devices have been developed for the purpose of improving the mechanics of a golfer's swing. For the most part and by and large, these devices use restraints which are rigged on the golfer's head, arms, hands, legs, torso and/or other body parts and work to align the golfer and/or golf club prior to the golf swing and/or work to control the golfer's movement and/or club movement during the golf swing. Other known devices utilize complicated contraptions for aligning the golfer prior to the golf swing and/or controlling the swing plane of the golf club during the golfer's swing. As can be appreciated, many of these devices are overly complicated and simply condition one aspect of the golf swing without necessarily addressing other aspects of the swing which are equally important for developing a good or "ideal" golf swing. For example, if a device simply teaches a golfer the proper positioning of his/her hands during the golf swing many other factors can still cause the ball to fly off-line, e.g., the golfer's head is improperly positioned or the golf club is improperly aligned prior to and/or during the golf swing.

Still other devices utilize sophisticated computer systems and videography to analyze a golfer's movement during the golf swing. As can be appreciated, these systems are quite expensive and do not necessarily provide instantaneous feedback which the golfer can readily employ and practice to improve his/her golf swing.

Still other devices employ mirrors to assist the golfer during the golf swing. However, it can be appreciated it is often difficult to properly align the mirrors for meaningful feedback since improper movement of the head often has negative impact on the golf swing.

While apparently generally acceptable for their intended purposes, by and large, the prior art devices are overly complicated and expensive necessitating the need for the development of a new, effective and inexpensive training aid for developing a consistent swing for various athletic activities.

SUMMARY OF THE INVENTION

Accordingly, it is an object of the present invention to provide an athletic training aid for assisting in the development an ideal or desired swing for any one of a number of sports, but which is especially intended for golf.

It is also an object of the present invention to provide a novel training aid which is economical to manufacture, durable and relatively of simple construction and design.

Still another object of the present invention is to provide a training aid which is portable and simple to set up and use.

Yet, another object of the present invention is to provide a training aid which is selectively adjustable for differently sized players.

Still, yet another object of the present invention is to provide a training aid which is selectively adjustable for differently sized swinging instruments such as golf clubs (e.g., driver versus a 7-iron).

It is also another object of the present invention to provide an aid which utilizes the player's shadow to develop a correct and consistent swing.

Certain of the foregoing and related objects are attained in accordance with the present invention by the provision of an athletic training aid for developing one's swing of a hitting instrument used in sports, e.g., golf club, bat, racket, and hockey stick. The invention comprises a "swing assembly"

having a mat-like surface and a plurality of reference markings disposed on the mat-like surface which define an ideal swing path of the hitting instrument. Preferably, the invention also comprises a plurality of reference points for determining an "ideal" body position for addressing and hitting the ball. The invention further comprises a light source for casting at least a portion of a player's shadow and a shadow of the hitting instrument onto the mat-like surface of the swing assembly in general relation to the markings which allows a player to readily visualize and compare the player's position and swing to the ideal body position and ideal swing path both prior to and during the course of the player's swing. Since different players have different body characteristics, a person may not be able to position themselves in an ideal manner for hitting the ball. Therefore, the reference markings should also permit a player to achieve or mimic the ideal swing with a non-deal body position.

Advantageously, the swing assembly provides a consistent and correct reference for several swing variables, e.g., swing plane, head position and shoulder position, relative to the ball. Since these variables of the golfer's swing are controlled, the golfer will more easily be able to correct and optimize other aspects of the swing which are a function of strength and individual body type.

Preferably, the light source is located behind the player and is selectively adjustable and/or moveable so as to accommodate for the player's height and/or the length of the swinging instrument. Advantageously, the plurality of reference markings are also selectively adjustable along the surface to accommodate for the same parameters, i.e., the player's height and/or club length.

Most advantageously, the surface containing the reference markings comprises a mat which is portable and selectively positionable on the ground. Preferably, the light source is also easily transportable and also selectively positionable on the ground surface.

Advantageously, the surface containing the reference markings also comprises at least one additional reference marking for positioning at least one of the player's body parts, e.g., the player's head, hands, feet, shoulders, etc. relative to the surface and the light source. Preferably, the surface also comprises at least one additional reference marking for positioning the swinging instrument prior to, during and after the player's swing.

It is another object of the present invention to provide a method of training a player's swing, comprising the steps of: 1) providing a swing assembly having a plurality of reference markings disposed on the swing assembly which define a desired swing path for the swinging instrument relative to the markings; 2) positioning a player with the swinging instrument proximate the swing assembly; and 3) projecting a light from a light source at the player and the swinging instrument both prior to and during a player's swing such that at least a portion of a player's shadow and a shadow of the swing instrument are cast onto the swing assembly in general relation to the markings. In other preferred embodiments, the method further comprises the step of adjusting the height, angle and horizontal position of the light source according to the height and club length of the player.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1A:
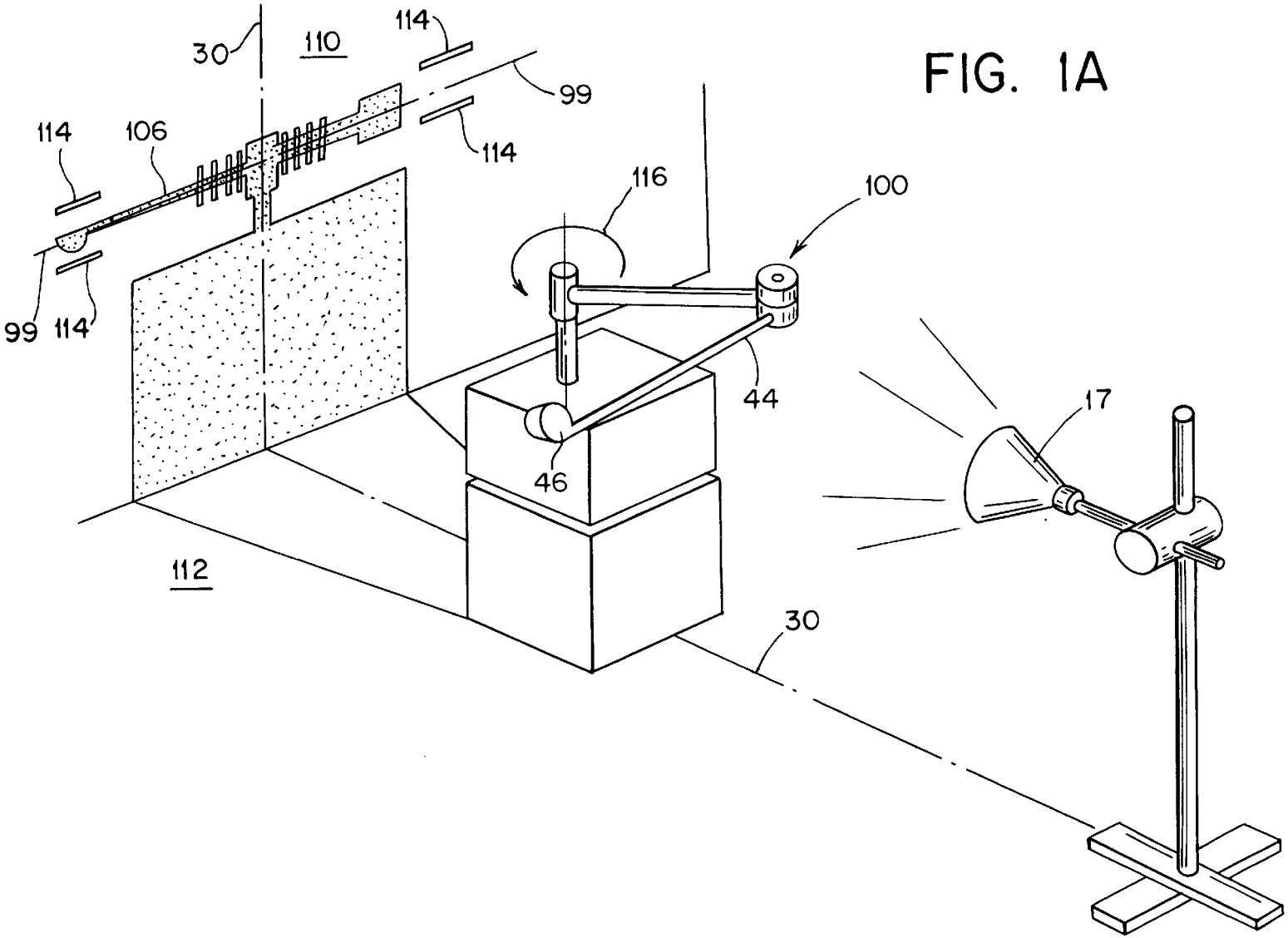
FIG. 1A is a perspective view of a light source projecting a light onto a mechanical swing device wherein the shadow of a golf club as it swings in an ideal horizontal plane is cast onto a wall.
Figure 1B:
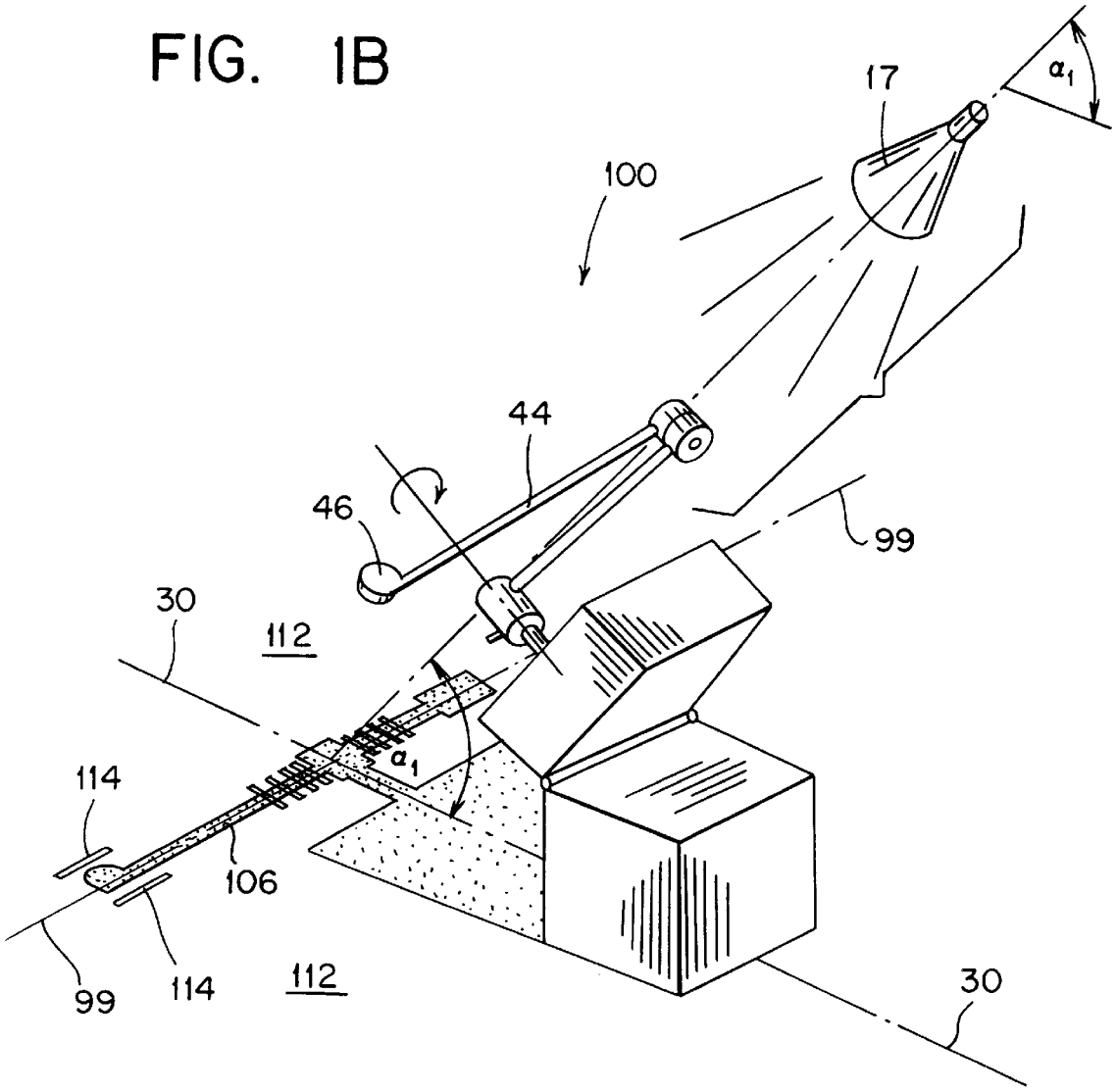
FIG. 1B is perspective view of the mechanical swing device and light source of FIG. 1A wherein the shadow of the golf club as it swings in an ideal angular plane is cast onto the ground surface.
Figure 1C:
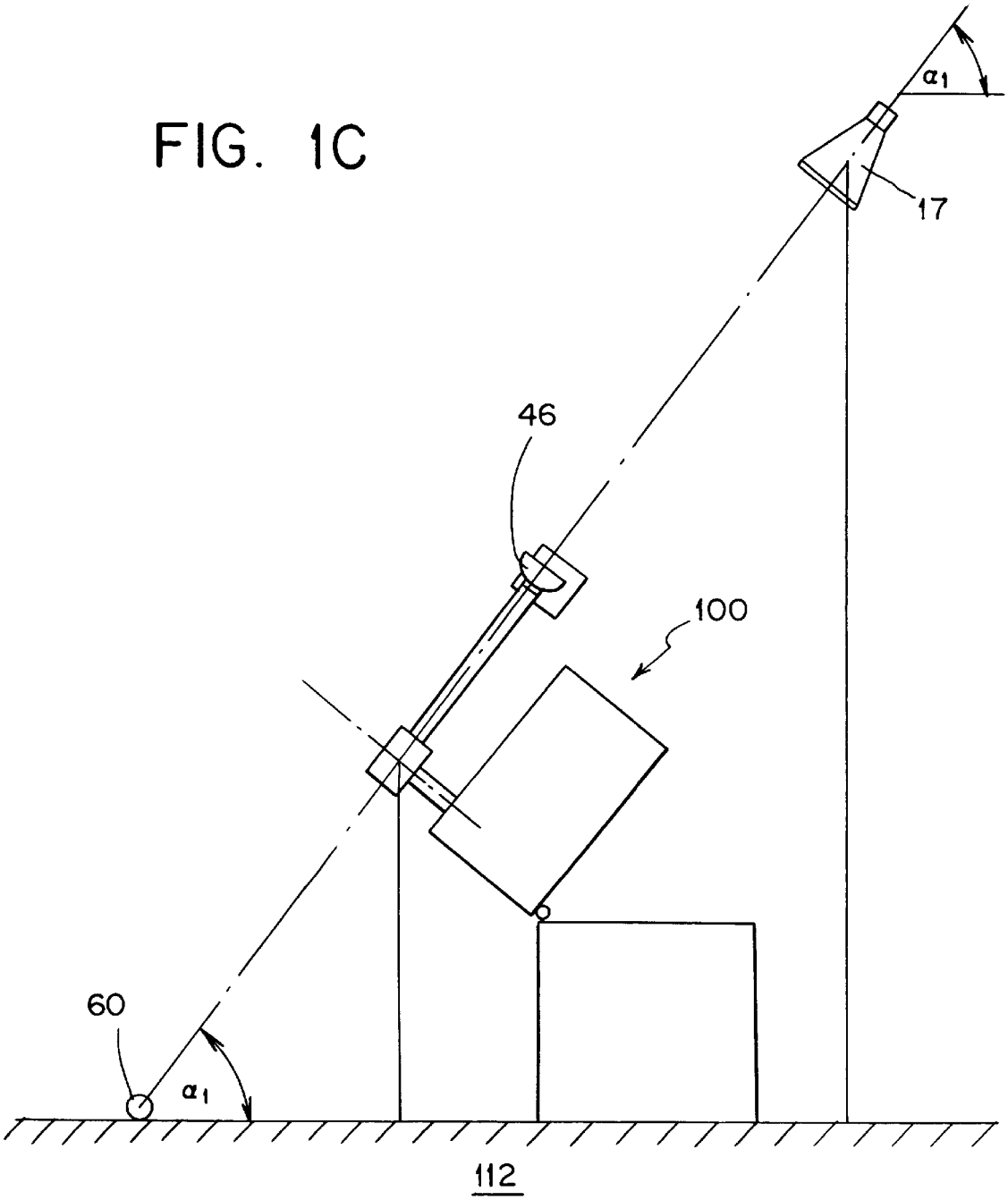
FIG. 1C is a side, elevational view of FIG. 1B showing the position of the golf ball in relation to the mechanical device and the light source.

Referring now to FIGS. 1A through 1C therein illustrated, by way of example, is a mechanical swinging device 100 which is used to test golf clubs and/or golf balls. As can be appreciated, the mechanical device is designed to emulate an ideal golf swing and is constructed to consistently swing along an ideal swing plane to achieve the maximum benefit at club head 46 to ball 60 impact, e.g., distance, consistency and accuracy. As depicted in the drawings, a light source 17 is positioned behind the mechanical swinging device 100 such that the shadow 106 of the golf club 44 is cast onto wall 110 (FIG. 1A) or ground surface 112 (FIGS. 1B and 1C) such that the ideal swing plane of the club 44 can easily be visualized.

Figure 3:
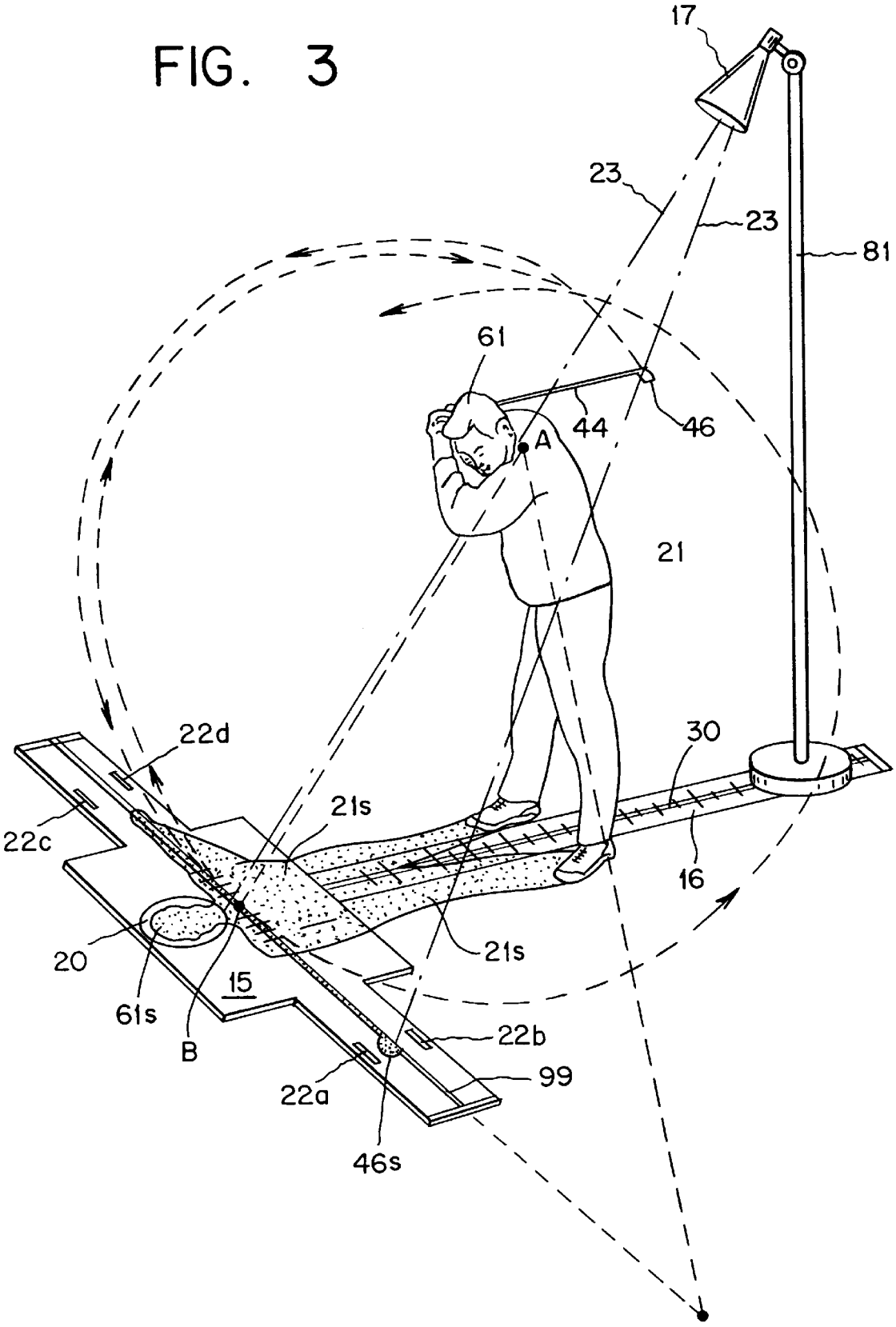
FIG. 3 is a perspective view of a player using the present invention with the ideal swing plane shown in phantom.

As illustrated in FIG. 3, the ideal swing plane is defined by three points: 1) the intersection of lines 30 and 99 (point B); 2) the target point (point C); and 3) the center of swing rotation, e.g., center of the player's spine at shoulder level (point A). As illustrated in FIG. 3, points A, B and C define a triangle which represents the ideal swing plane. As can be appreciated, items that move along the ideal swing plane will also move along target line 99.

For example, if the mechanical swing device 100 is set up in the manner depicted in FIG. 1B and FIG. 1C, the shadow of the club head moving in the ideal swing plane of the golf club 44 prior to, during and after the golf swing will be cast onto the ground surface 112 and will move along swing reference line 99, preferably between reference markers 114 located on either side of the intersection of lines 30 and 99.

By arranging the mechanical swing device 100 in this fashion, it has been seen that the forces that tend to change the club 44 path are minimized when the club 44 is swung in a plane normal to the axis of rotation 116 of the swing device 100. Ideally, a player tries to mimic this ideal swinging movement during his/her golf swing.

Referring now to present invention and, in particular, FIGS. 2 through 6 which depict a training aid for developing a swing generally identified by reference numeral 10. Training aid 10 comprises a swing surface or plate generally designated by reference numeral 12 which includes top faceplate 15, sides 13*a*–13*d* and bottom side (not shown). Preferably, plate 12 is attached to an extension mat or guide portion 24 such that the free ends 26*a* and 26*b* of portion 24 generally extend beyond the sides 13*b* and 13*d* of plate 12.

Training aid 10 also comprises a light source 17 (see FIGS. 4A–4D) which is used to project a light 23 onto a player 21 holding a golf club 44 such that the player's shadow 21*s* and the shadow of the golf club 44*s* (see FIGS 5A and 5B) are both cast onto the plate 12 and/or guide portion 24 prior to and during the player's 21 golf swing (when the player 21 addresses the ball, the player's body will naturally block the shadow 44*s* of the club). As explained in further detail below with reference to FIGS. 4A–4D and 5A–5C, the height, horizontal position and/or angle of the light source 17 is adjustable and/or moveable so as to accommodate different club lengths and/or different player 21 heights.

Figure 2:
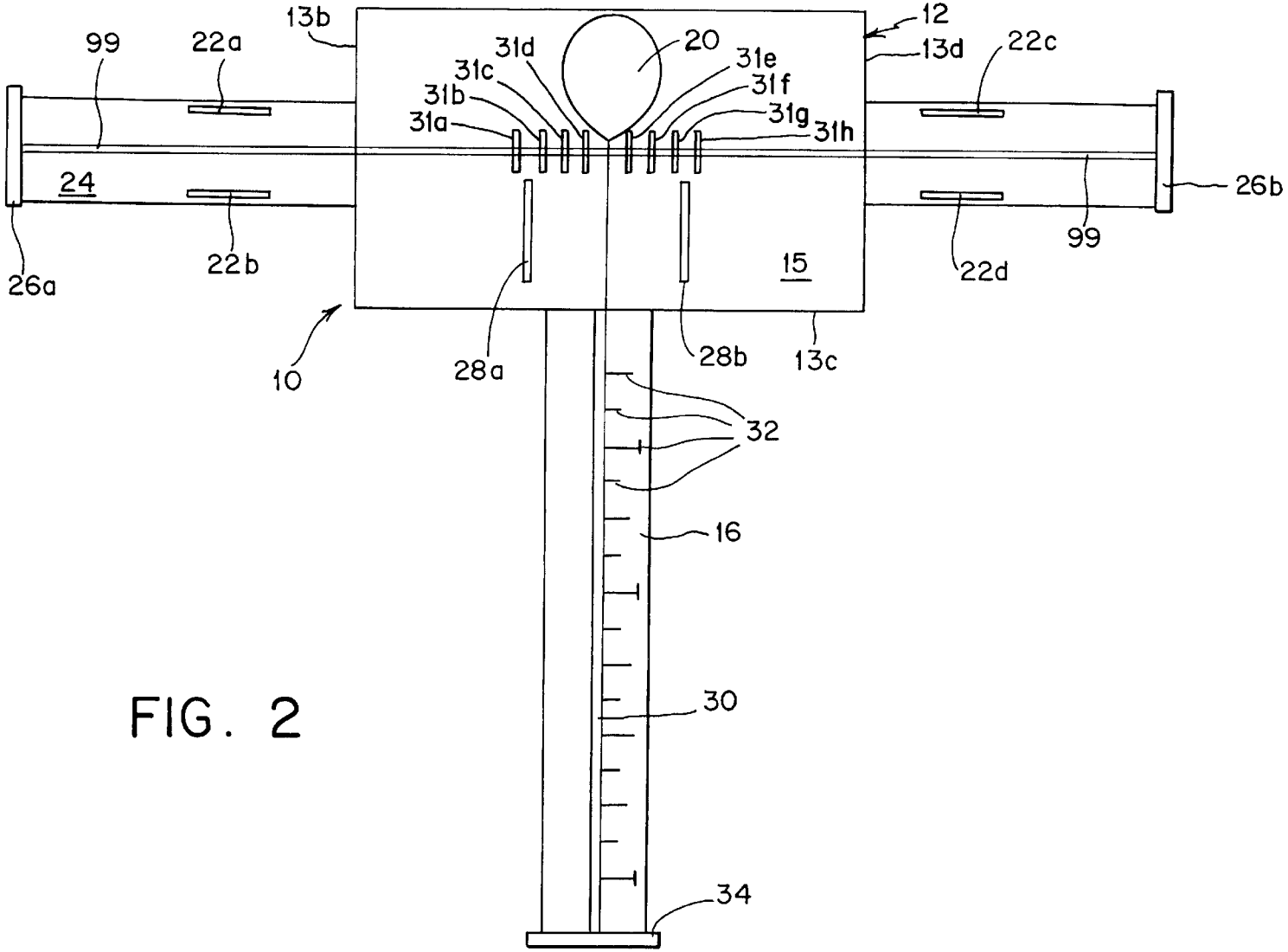
FIG. 2 is a top view of the swing assembly and centerline adjustment portion of the present invention.
Figure 6:
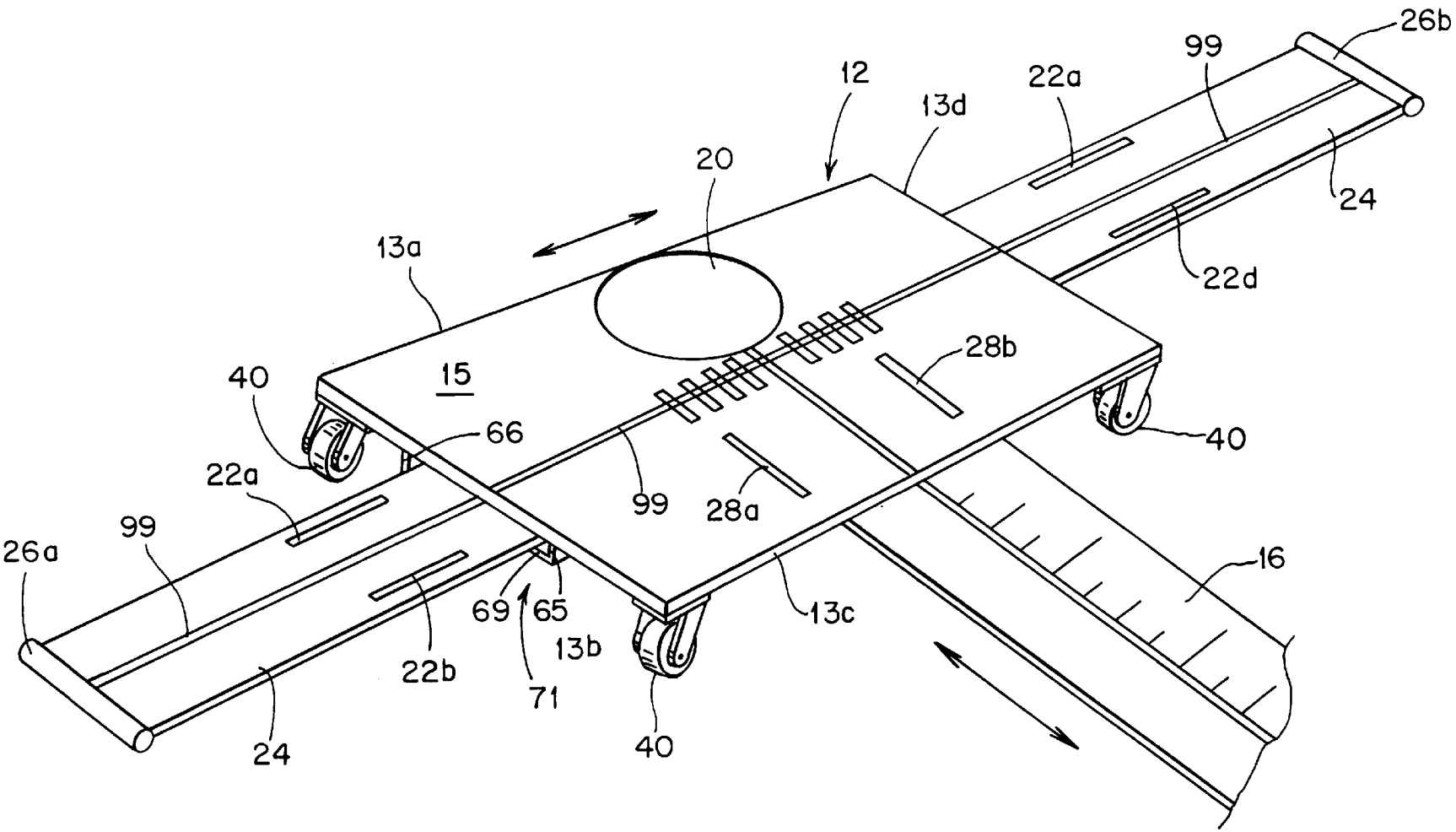
FIG. 6 is a fragmentarily-illustrated perspective view of a second embodiment of the swing assembly shown with a centerline adjustment portion.

As best seen in FIGS. 2, 3 and 6, swing plate 12 also comprises a plurality of reference markings 31*a*–31*h* disposed on faceplate 15 for generally positioning the golf ball 60 and aligning a golf club 44 with the reference markings 31*a*–31*h*. Preferably, reference markings 31*a*–31*h* are symmetrically positioned about a center line 30 which extends from side 13*a* to 13*c* of plate 12. Most desirably, reference markings 31*a*–31*h* are positioned normal to a swing line 99 which extends from end 26*a* of guide portion 24 across faceplate 15 of plate 12 to end 26*b* of guide portion 24.

Advantageously, swing plate 12 also comprises a plurality of additional reference markings 28*a* and 28*b* disposed on faceplate 15 of plate 12 for positioning a shadow of a portion of a player's body, e.g., shoulders, torso, hips, etc., in general alignment with swing line 99, markings 31*a*–31*h* and/or center line 30 prior to and during the swing movement. Preferably, a third reference marking 20 is disposed on faceplate 15 for positioning the shadow of a person's head (see FIGS. 5A–5C) prior to and during the swing movement. In the particular embodiment shown in the figures, head marking 20 is symmetrical about centerline 30, but in some cases it may be desirable to dispose head marking 20 in an asymmetrical fashion about centerline 30. As can be appreciated from the present description, since the player's head is connected to the center of rotation (center of spine at shoulder level), the player's head will typically be located above the intersection of lines 30 and 99 and the ball position can be moved to various locations 31*a*–31*h* depending upon the club being used.

FIGS. 2 and 6 also illustrate guide portion 24 having a plurality of reference markings 22*a*–22*d* disposed thereon. Preferably, markings 22*a*–22*d* are paired (i.e., 22*a*, 22*b* and 22*c*, 22*d*) and each pair is positioned parallel and in symmetrical fashion about swing line 99. As can be appreciated and as explained in more detail with reference to FIGS. 5A-5E, during the swing movement, the player 21 works to swing the club 44 such that the club's shadow 44s generally moves along center line 99 and between each pair of reference markings, e.g., 22*c*, 22*d* during the back swing, 22*a*, 22*b* towards the top of the swing and 22*c*, 22*d* during the downstroke.

In one embodiment of the swing assembly shown in FIG. 6, guide portion 24 is positionable along a centerline adjustment portion 16 so as the player's shadow 21*s* can be aligned with the swing assembly, i.e., guide portion 24 and swing plate 12, and accommodate different club lengths and/or different player heights. Preferably, the adjustment portion comprises a bar or mat which extends from plate 12. Most desirably, plate 12 is attached to guide portion 24 and the entire swing assembly is slideably adjustable along adjustment portion 16.

For example in FIG. 6, two flanges 65 and 66 depend from the bottom of plate 15 and are joined at the distal ends by a common portion 69 so as to define a guide rail 71 having a generally C-shaped cross section. As can be appreciated, guide portion 24 is disposed within the guide rail 71 such that top plate 12 is slideably positionable along guide portion 24.

Advantageously, adjustment portion 16 is centrally located about the swing assembly such that adjustment portion 16 generally extends from plate 12 normal to side 13*c* of plate 12. FIGS. 2 and 6 also illustrate center line 30 extending from side 13*a* to the free end 34 of adjustment portion 16 which also helps to align the player with the swing assembly to facilitate proper movement along the desired swing plane. Most desirably, the adjustment portion 16 is graduated via markings 32 so as to expedite set up, e.g., positioning of the light source 17 relative to the player for different club lengths and/or player heights.

In one embodiment, the swing assembly and the adjustment portion 16 are removably attached to one another to facilitate portability of the present invention. However, in some cases it may be preferable to have the adjustment portion and the swing assembly (swing plate 12 and guide portion 24) formed as a single unit, e.g., as a single piece of fabric which can be rolled and laid out on a floor (see FIG. 3). As can be appreciated, designing the training aid 10 in this fashion will greatly simplify the present invention. For example, the swing plate 12 would simply comprise a mat-like rectangularly-shaped piece of fabric and the guide portion 24 (e.g., the same fabric and/or another piece of fabric) would extend from the sides of the plate 12 along the swing line 99. Additional fabric would extend normal to the swing line 99 along centerline 30 and make up the adjustment portion 16.

In another embodiment as illustrated in FIG. 6, top plate 12 is positioned atop portion 16 such that plate 12 is moveable along portion 16. More particularly, plate 12 comprises a plurality of wheels 40 which depend therefrom and which facilitate movement of the plate 12 along portion 16. However, in some cases it may be preferable to secure these elements, namely the swing assembly and the portion 16, to a stationary practice surface in a more secure manner so as to set up a swing studio or swing training center. As can be appreciated, when the swing assembly and portion 16 are secured in this manner, light source 17 is adjustable so as to accommodate different club lengths and/or player heights.

As seen in FIG. 6, the plate 12 also comprises wheels or rollers 40 which are preferably attached to bottom plate (not shown) so as to facilitate movement of the swing assembly (guide portion 24 and plate 12) along adjustment portion 16. In some cases, however, it may be preferably to utilize some other mechanism for facilitating movement of the swing assembly relative to the adjustment portion, e.g., guide rails.

Figure 4A:
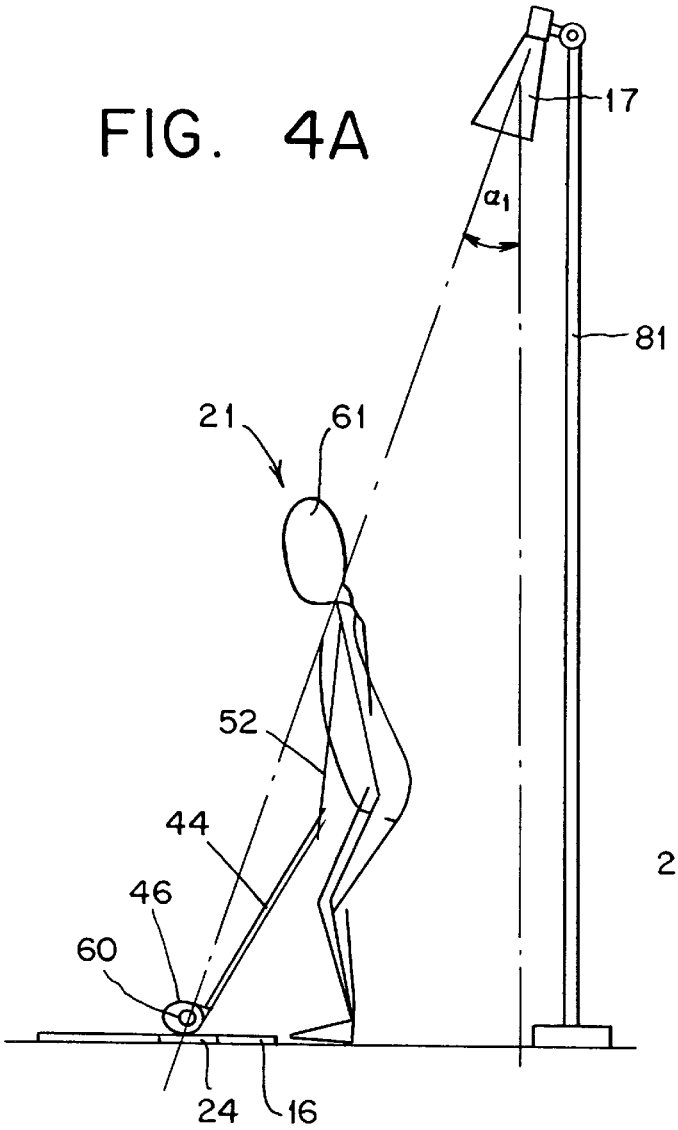
FIGS. 4A is an elevational view of one embodiment of the present invention showing a player using a "7-iron" and positioned relative to the light source.
Figure 4B:
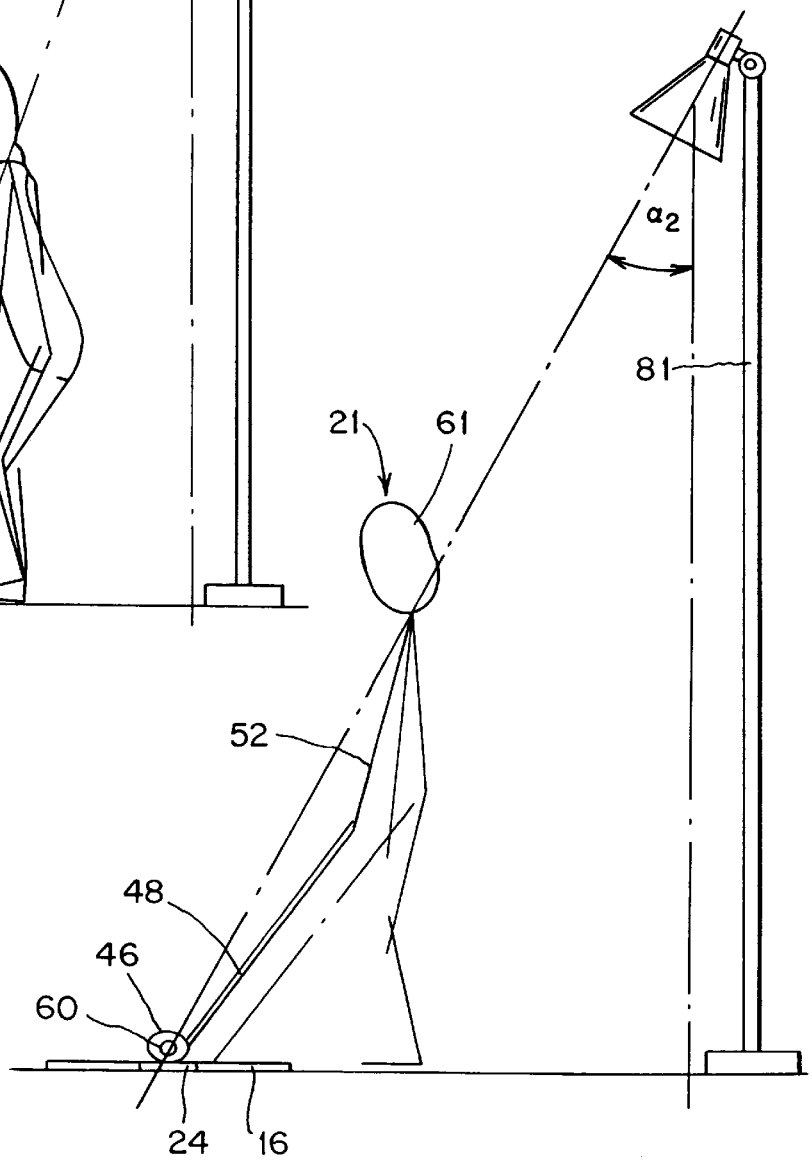
FIGS. 4B is an elevational view of the embodiment of FIG. 4A showing the player using a "driver" and positioned relative to the light source.

Turning now to FIGS. 4A and 4B, which depict a player 21 in a poised position prior to swinging the golf club; FIG. 4A depicts the player poised with a short iron, e.g., 7-iron 44 and FIG. 4B depicts the player 21 poised with a longer club, e.g., a driver 48. As can be appreciated, with the short iron 44, the player 21 is positioned closer to the ball 60 and swings the club 44 along a generally more vertical swing plane. Thus, in order to properly cast the player's shadow 21*s* (see FIGS. 5A–5C) and the shadow of the club 44*s* onto or with reference to the reference markings 99, 28*a* and 28*b* of the swing assembly, the light source 17 must be positioned above and behind the player 21 at a generally acute angle $\alpha_1$ (see also FIG. 1C). The exact position that the player's shadow will cast onto the swing plane is determined by moving the light 17 and/or light stand 81 closer or farther away from the swing assembly and/or adjusting the height and/or angle of the light 17. Preferably, the shadow of the golfer's center of rotation 98 fall on the intersection of lines 30 and 99.

In contrast, with a longer club, e.g., the driver 48 of FIG. 4B, a player 21 will naturally stand further from the ball 60 and swing along a more lateral swing plane. Thus, in order to properly cast the player's shadow 21*s* and the shadow of the club 48*s* (see FIGS. 5A–5C) onto the reference markings 99, 28*a* and 28*b* of the swing assembly, the light source 17 must be positioned above and behind the player at a generally greater angle $\alpha_2$. Like-wise and depending upon the length of the club 44, 48 being used, the swing assembly may have to be positioned along the adjustment portion 16 such that the player's shadow 21*s* and the shadow of the club 44*s* and club head 46*s* are all cast onto the swing assembly in proper alignment with the reference markings 31*a*–31*h*, 28*a* and 28*b* and 20.

Figure 4C:
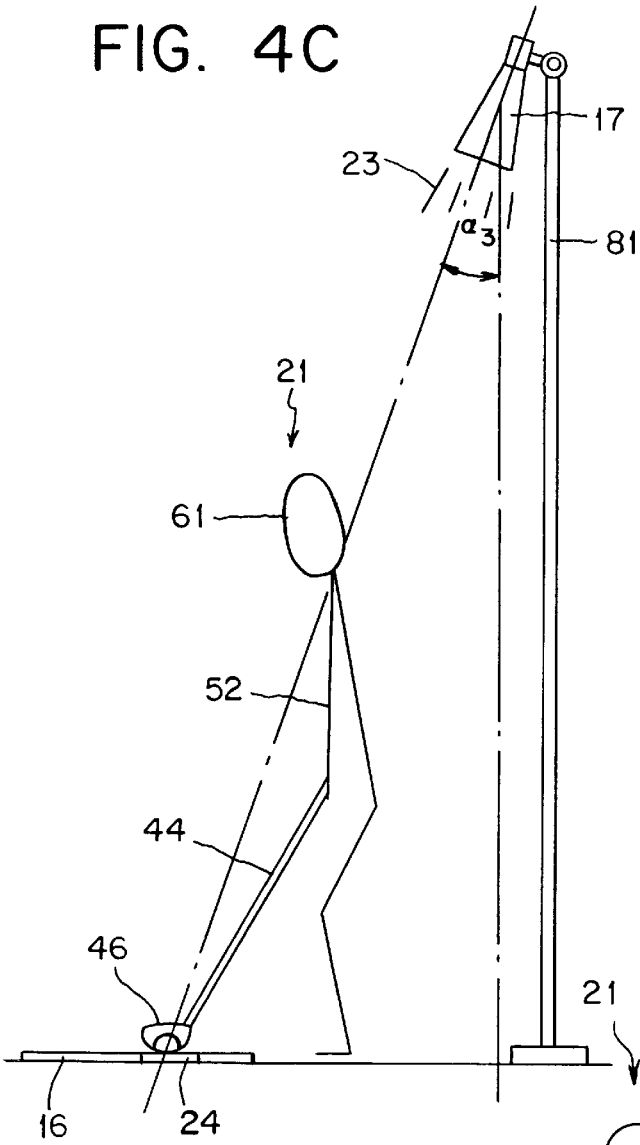
FIGS. 4C is an elevational view of one embodiment of the present invention showing a tall player positioned relative to the light source and aligned for swing the golf club.
Figure 4D:
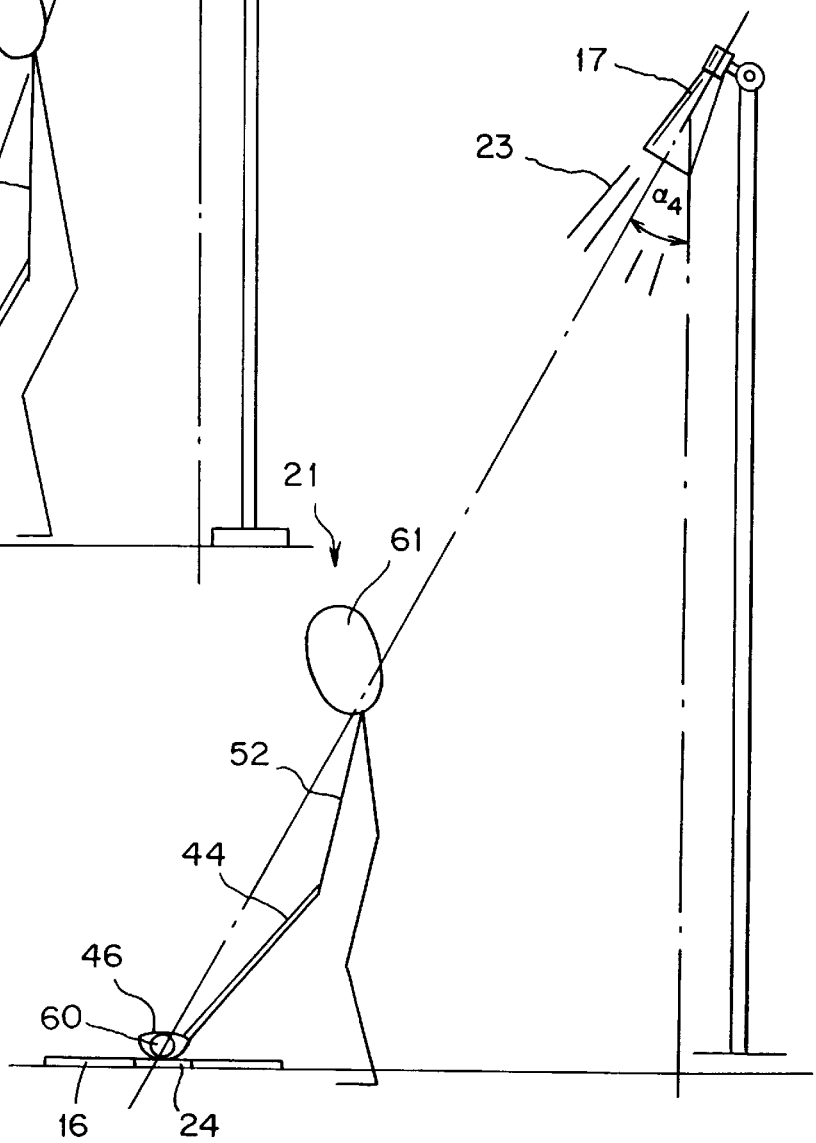
FIGS. 4D is an elevational view of the embodiment of FIG. 4C showing a shorter player positioned relative to the light source and aligned for swing the golf club.

In much the same fashion, FIGS. 4C and 4D also depict the player 21 in a poised position prior to swinging the golf club 44, 48; FIG. 4C depicts a generally tall person using the training aid 10 and FIG. 4D depicts a smaller person using the training aid 10. Preferably, light source 17 and/or the swing assembly are adjustable so as to accommodate for the varying heights of different of players 21. For example, with a taller player 21 of FIG. 4C the light source 17 is positioned closer to the swing assembly so as to project light 23 at an acute angle $\alpha_3$ whereas with the smaller player 21 of FIG. 4D, the light source 17 is positioned further from the player 21 so as to project the light 23 at a greater angle $\alpha_4$. Likewise and depending upon the height of the player 21, the swing assembly may have to be positioned along the adjustment portion 16 such that the player's shadow 21*s* and the shadow of the club 44*s* and club head 46*s* are all cast onto the swing assembly in proper alignment with the reference markings 31*a*–31*h*, 28*a* and 28*b* and 20.

Figure 5A:
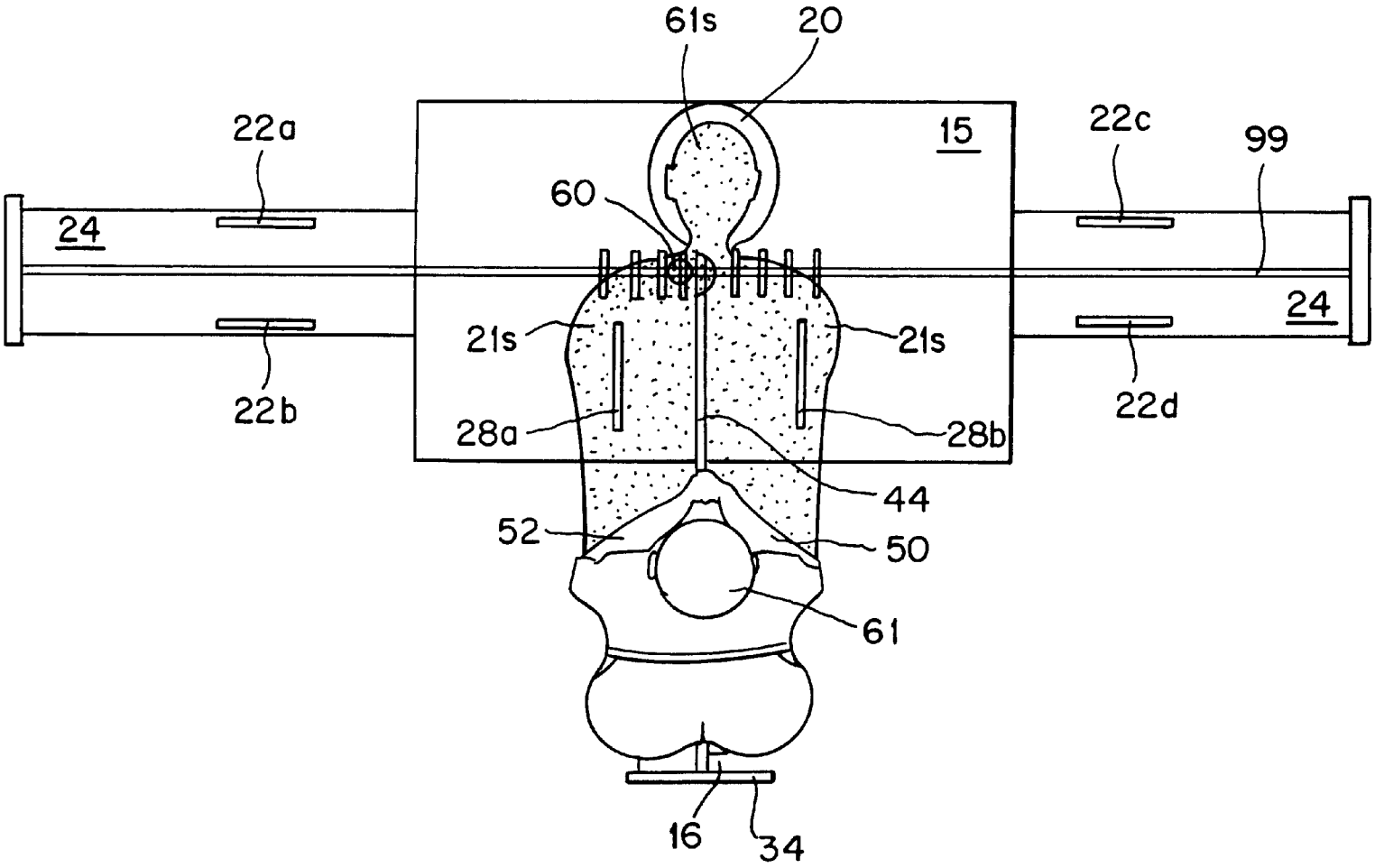
FIG. 5A is a top view of the present invention showing a golfer's shadow cast onto the swing assembly prior to swinging a golf club.
Figure 5B:
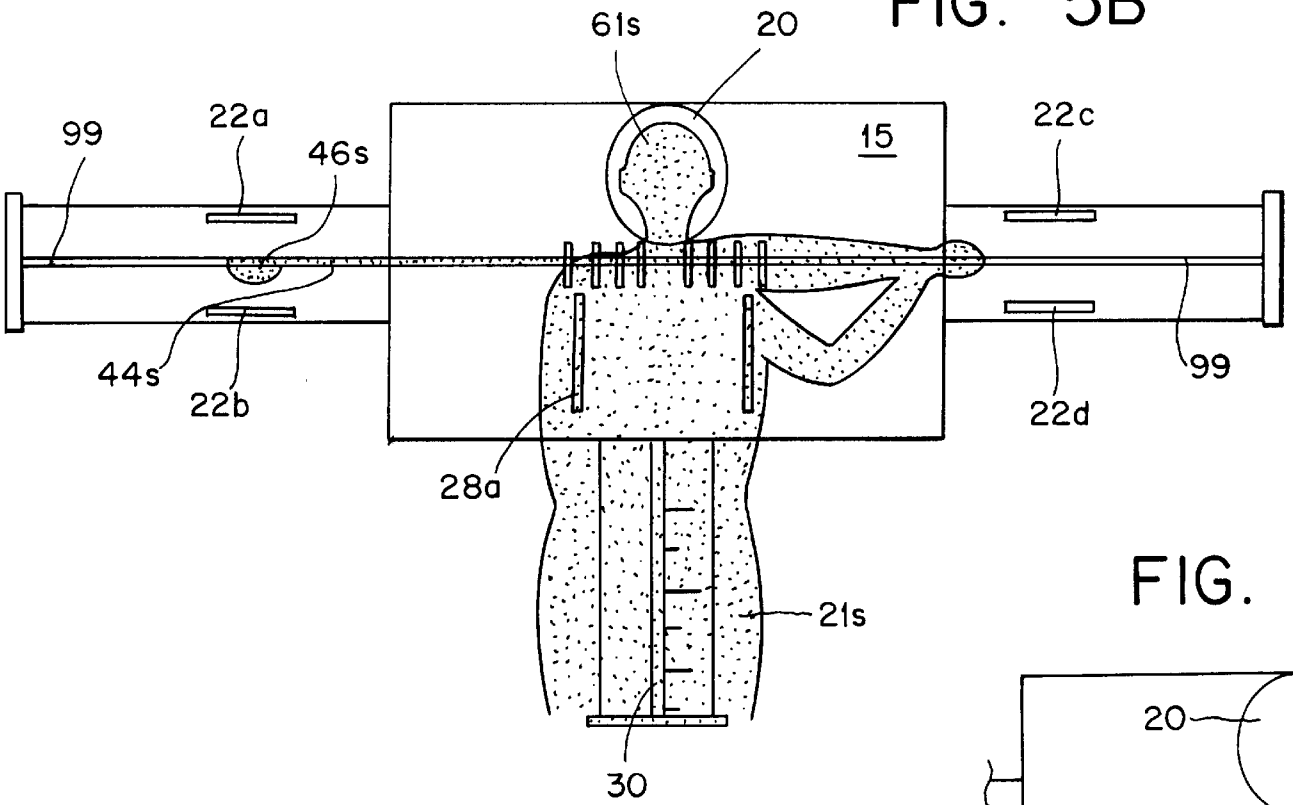
FIG. 5B is a top view of the present invention showing the golfer's shadow cast onto the swing assembly along a correct swing path during the golf swing.
Figure 5D:
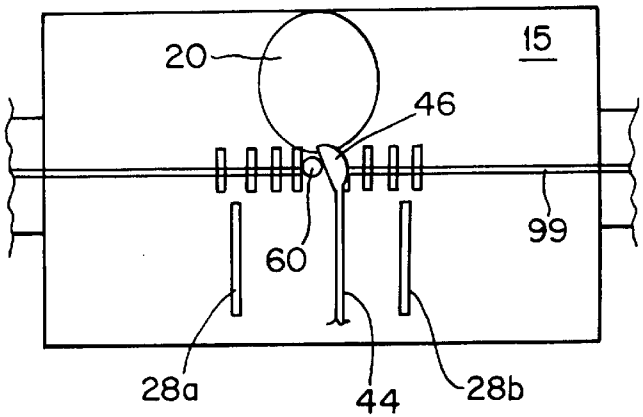
FIG. 5D is an enlarged, top view of the present invention showing the position of the club head relative to the ball at impact to produce a draw.
Figure 5C:
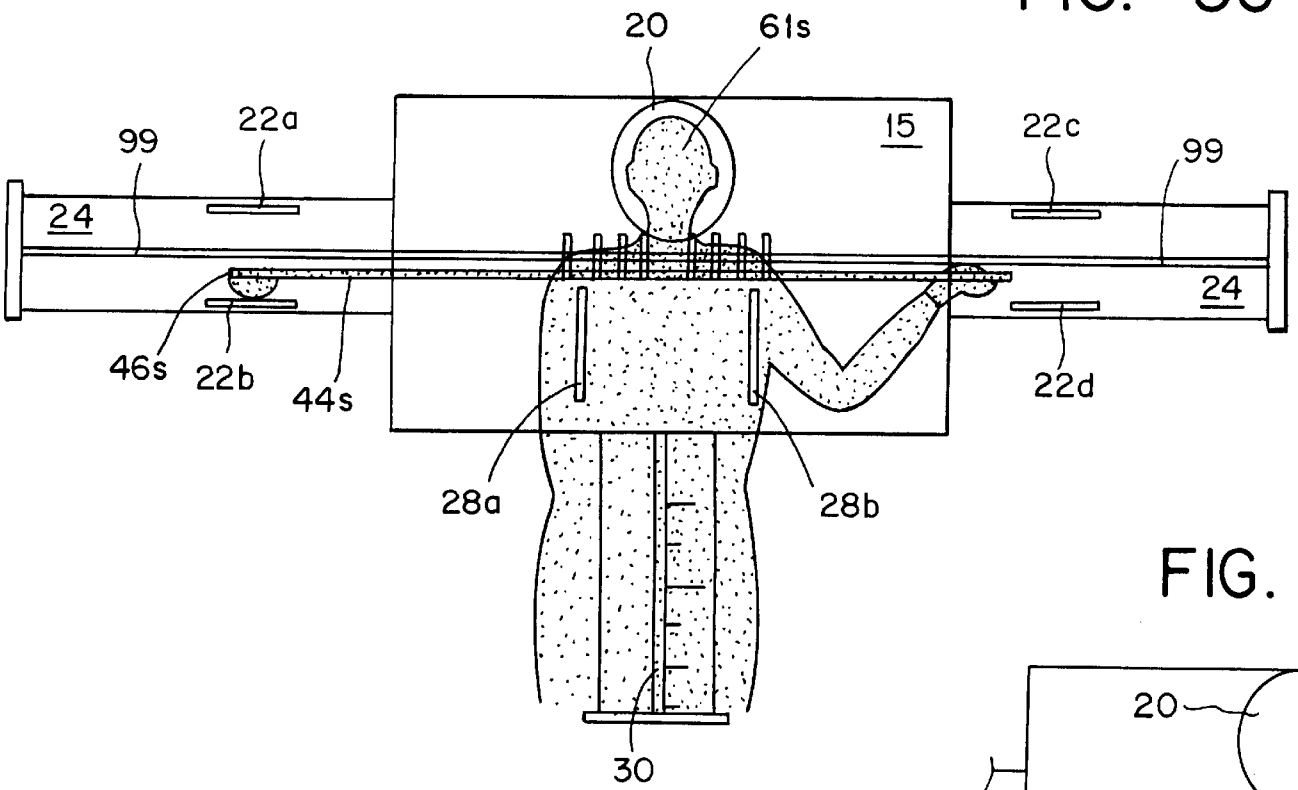
FIG. 5C is a top view of the present invention showing the golfer's shadow cast onto the swing assembly along a less than ideal swing path during the golf swing.
Figure 5E:
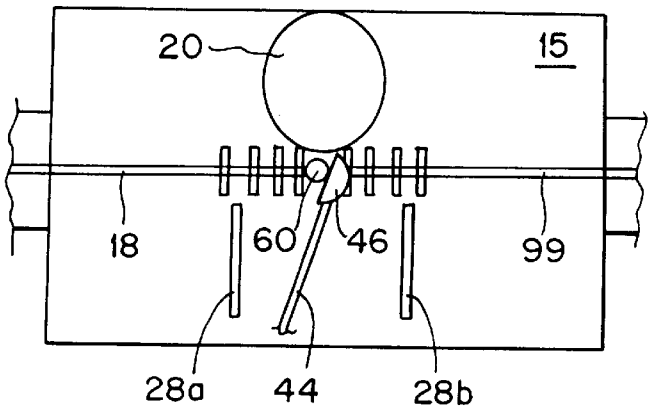
FIG. 5E is an enlarged, top view of the present invention showing the position of the club head relative to the ball at impact to produce a fade.

Turning now to FIGS. 5A–5C which depict the player's shadow 21*s* cast onto the swing assembly (guide portion 24 and plate 12); FIG. 5A shows the player 21 prior to swinging and FIGS. 5B and 5C show the player 21 during the swing. In particular, FIG. 5A shows the shadow 21*s* of the player 21 as it would look from the standpoint of the player 21 prior to swinging the club 44, i.e. as the player 21 addresses the ball 60. As can be appreciated, when positioned in this manner, the player 21 moves his/her arms 50, 52 so as to align the club head 46 about the ball 60 in conformity with the reference markings. The player 21 also moves his/her head 61 (not shown) such that the shadow 61*s* of the player's head 61 is positioned within reference marking 20 and the shadow 21*s* of the player's body 21 (torso) is generally aligned with reference marker 28*a*.

Upon initiating the swing movement, the player 21 draws club 44 and club head 46 backward such that the shadow of the club head 46*s* moves across the plate 12 and the guide portion 24 along centerline 99 and between the pair of club head reference markers 22*c* and 22*d*. At the same time, the player 21 twist's his/her torso in such a fashion that the shadow 21*s* of the player's body 21 is maintained in general alignment with marker 28*a*. As can be appreciated, reference markings 28*a* and 28*b* allow a player 21 to readily visualize his/her shoulder rotation at the top of the swing.

Ideally, during this initial movement and as the club 44 and the club head 46 are drawn off the swing assembly towards the top of the golf swing, the shadow 44*s* of the club 44 and the shadow 46*s* of the club head 46 are also aligned with centerline 99 and are cast between marker 22*c* and 22*d*. As discrepancies in the position of the shadow are observed, a player can make adjustments to his/her swing instantly.

As can be appreciated, the player 21 works to maintain the alignment of the club's shadow 44*s* and the club head shadow 46*s* with centerline 99 and between the reference marker pairs 22*c*, 22*d* and 22*a* and 22*b* during the course of the entire golf swing. Advantageously, the player works to keep his/her body aligned with marker 28*a* and his/her head aligned with marker 20 during the entire swing movement. For example, FIGS. 5B and 5C show the alignment of the player's club 44 at the top of the golf swing; FIG. 5B shows the player 21 swinging the club 44 in a correct fashion along the "ideal" swing plane whereas FIG. 5C depicts the player 21 swinging the club 44 along a less than ideal swing plane.

In particular, FIG. 5B shows the club's shadow 44*s* and the club head shadow 46*s* perfectly aligned at the top of the swing with centerline 99 and between club markers 22*a* and 22*b*. In addition, the shadow 21*s* of the player's body and the shadow of the player's head are also perfectly aligned with their respective markings, e.g., 28*a* for shoulders and torso and 20 for the player's head, respectively. Preferably, the shadow of the player's arm 52*s* also aligns with centerline 99. As can be appreciated, FIG. 5B represents the "ideal" golf swing which the player 21 works to develop.

FIG. 5C, on the other hand, shows the less than ideal top of the golf swing position. In particular, FIG. 5C shows club's shadow 44*s* and club head shadow 46*s* skewed or mis-aligned with respect to centerline 99 at the top of the player's 21 golf swing. More particularly, the clubs shadow 44*s* is skewed below centerline 99 such that the club head shadow 46*s* is cast proximate reference marker 22*b* and away from marker 22*a*. In addition, the shadow of the player's arm 52*s* is also skewed below centerline 99. As can be appreciated, FIG. 5C represents a less than ideal golf swing and in most cases will typically result in the golf ball 60 flying off-line, e.g., the ball will "hook".

However, even if the club's shadow 44*s* and the shadow of the club head 46*s* are aligned with centerline 99 throughout the entire golf swing, other factors can also result in the ball 60 flying off-line. For example, during the swing, the player's body 21 or the player's head 61 may move erratically and either or both may become mis-aligned with their respective reference marking 28*a*, 20. Moreover, a player may swing the club 44 in such a fashion that the shadows of the club 44 and club head 46*s* are skewed above the centerline 99 which can also result in the ball 60 flying off-line, e.g., slice. As can be appreciated, by utilizing the training aid 10 of the present invention, it will readily become apparent to the player during his/her golf swing which aspect of his/her swing is inconsistent with the "ideal" golf swing.

From the foregoing and with reference to the various figure drawings, those skilled in the art will appreciate that certain modifications can be made without departing from the scope of the present invention. For example, although the figure drawings depict swing plate 12 as a generally rectangular surface, other geometric shapes, e.g., circular, triangular and/or polygonal can be utilized to define the swing plate 12. Moreover, the various figure drawings only depict one possible arrangement of the plurality of reference markings 31*a*–31*h*, 20, 28*a* and 28*b* with respect to the game of golf. Other arrangements for the game of golf and/or arrangements for other sports, e.g., baseball and tennis, can be disposed on the swing plate 12 as well. In one particular embodiment, the markings on the swing plate 12 are selectively positionable anywhere on the swing plate 12 to accommodate for various players and/or to switch between practicing different swings for different sports. For example, the markings can be made from a metallic material and the swing plate 12 can be magnetic such that the markings are positionable anywhere on the swing plate 12. As can be appreciated other means of selectively adhering the markings can also be employed, e.g., synthetic hook and loop fastening strips that adhere when pressed together commonly sold under the trademark VELCRO®.

Preferably, the present invention is portable such that it can be easily transported and set up where desired. However, in some cases it may be desirable to permanently secure the swing assembly (guide portion 24 and swing plate 12) to a surface or display or project the swing assembly on a surface and position the light source 17 accordingly such that the present invention remains at one location, e.g., a swing training studio. As can be appreciated, the light source 17 of this particular embodiment would still remain selectively positionable to accommodate for various club lengths and player heights and the player would position himself/herself accordingly to accommodate for the same.

As mentioned above, one embodiment of the present invention includes a one-piece fabric having a mat-like swing surface, a swing guide mat which forms apart of the mat-like surface and which extends from either side thereof. An adjustment portion also forms a part of the surface and extends from the bottom side of the surface perpendicular to the guide portion. However, in some cases it may be preferable to have guide portion 24 and/or adjustment portion 16 selectively removeable from the swing surface by VELCRO® or a snap-fit mechanism.

Preferably with this embodiment, reference markings 99, 31*a*–31*h*, 20, 22*a*–22*d*, 28*a* and 28*b*, are incorporated into the fabric and permit a player to position himself/herself accordingly to strike the ball. In one particular embodiment, the swing guide portion and swing target line 99 extend 8' on either side of the ball 60 to provide visual reference of the ideal swing plane during the entire swing. A mat of this size is practical for a training studio or other permanent location where portability in not necessarily required. On the other hand, guide portion 24 and swing line 99 may be designed as fabric strips which could be rolled up for storage or easy transport.

Although the illustrated embodiments show the present invention set up for right-swinging players, as can be appreciated, the invention can also be set up to train left-swinging players as well.

There have been described and illustrated herein several embodiments of a swing training aid for use by players to develop their respective sports swings. While particular embodiments of the invention have been described, it is not intended that the invention be limited thereto, as it is intended that the invention be as broad in scope as the art will allow and that the specification be read likewise. It will therefore be appreciated by those skilled in the art that yet other modifications could be made to the provided invention without deviating from its spirit and scope as so claimed.

What is claimed is:

1. An athletic training aid for developing one's swing of a hitting instrument used in sports, comprising:

a swing assembly comprising a mat-like surface and a plurality of reference markings disposed on said mat-like surface which define an ideal body position and an ideal swing path of the hitting instrument; and means for casting at least a portion of a player's shadow and a shadow of the hitting instrument onto said mat-like surface of said swing assembly in general relation to said markings which allows a player to readily visualize and compare the player's position and swing to the ideal body position and ideal swing path both prior to and during the course of the player's swing.

2. An athletic training aid according to claim 1, wherein said swing assembly further comprises a guide portion which extends from said mat-like surface to further define said ideal swing path.

3. An athletic training aid according to claim 2 wherein said mat-like surface is selectively removable from said guide portion.

4. An athletic training aid according to claim 2, wherein said guide portion further comprises at least one reference marking disposed thereon which allows said player to readily visualize and compare the player's swing path to the ideal swing path during the course of the player's swing.

5. An athletic training aid according to claim 2, wherein said training aid further comprises an adjustment portion which extends from said mat-like surface in a normal direction relative to said guide portion.

6. An athletic training aid according to claim 5, wherein said swing assembly is moveable along said adjustment portion such that said swing assembly can be adjusted according to said player's height and club length.

7. An athletic training aid according to claim 6, wherein said adjustment portion further comprises a plurality of reference markings which allows a player to more readily adjust said swing assembly along said adjustment portion according to said player's height and club length.

8. An athletic training aid according to claim 1, wherein said hitting instrument is a golf club.

9. An athletic training aid according to claim 1, wherein said swing assembly is portable.

10. An athletic training aid according to claim 1, wherein said casting means comprises a light source.

11. An athletic training aid according to claim 10, additionally including means for adjusting the height, horizontal location and the angle of said light source.

12. An athletic training aid according to claim 1, wherein said plurality of reference markings are selectively positionable on said mat-like surface of said swing assembly.

13. An athletic training aid according to claim 1, wherein said mat-like surface of said swing assembly comprises at least one additional reference marking for positioning at least one portion of said player's shadow prior to said swing.

14. An athletic training aid according to claim 1, wherein said mat-like surface of said swing assembly comprises at least one additional reference marking for positioning at least one portion of said player's shadow during said swing.

15. An athletic training aid according to claim 13, wherein said at least one additional reference marking positions the shadow of the player's head.

16. An athletic training aid according to claim 1, wherein said mat-like surface of said swing assembly comprises at least one additional reference marking for positioning at least a portion of said hitting instrument relative to said plurality of reference markings prior to the player's swing.

17. A method of training a player's swing of a hitting instrument, comprising the steps of:

providing a swing assembly comprising a mat-like surface and a plurality of reference markings disposed on said mat-like surface which define an ideal body position and an ideal swing path of the hitting instrument;

positioning a player with the hitting instrument proximate said swing assembly; and projecting a light from a light source such that said light casts at least a portion of a player's shadow and a shadow of the hitting instrument onto said mat-like surface of said swing assembly in general relation to said markings which allows a player to readily visualize and compare the player's position and swing to the ideal body position and ideal swing path both prior to and during the course of the player's swing.

18. A method according to claim 17, wherein prior to said projecting step, the method further comprises the step of adjusting the height, position and angle of said light source according to the height and club length of said player.

19. A method according to claim 17, wherein said swing assembly of said providing step further comprises a guide portion which extends from said mat-like surface to further define said ideal swing path.

20. A method according to claim 19, wherein said mat-like surface of said providing step is selectively moveable from said guide portion.

21. A method according to claim 20, wherein said guide portion of said providing step further comprises at least one reference marking disposed thereon which allows said player to readily visualize and compare the player's swing path to the ideal swing path during the course of the player's swing.

* * * * *